United States Patent [19]

Tanaka et al.

[11] Patent Number: 4,501,691

[45] Date of Patent: Feb. 26, 1985

[54] PROCESS FOR TREATING A RADIOACTIVE LIQUID WASTE

[75] Inventors: Shoichi Tanaka, Tokyo; Yoshiharu Tanaka, Okayama; Eiji Takano, Ibaragi, all of Japan

[73] Assignee: Mitsubishi Kinzoku Kabushiki Kaisha, Tokyo, Japan

[21] Appl. No.: 414,915

[22] Filed: Sep. 3, 1982

Related U.S. Application Data

[63] Continuation of Ser. No. 149,034, May 12, 1980, abandoned.

[30] Foreign Application Priority Data

Dec. 25, 1979 [JP] Japan ..... 54-169076

[51] Int. Cl.[3] ..... G21F 9/10

[52] U.S. Cl. ..... 252/631; 210/682; 423/11; 423/12

[58] Field of Search ..... 252/631; 210/682; 423/11, 12

[56] References Cited

U.S. PATENT DOCUMENTS 4,338,286 7/1982 Nakai et al. ..... 423/11
4,349,513 9/1982 Ishiwata et al. ..... 423/11

FOREIGN PATENT DOCUMENTS 48-38320 11/1973 Japan .
53-27800 3/1978 Japan .

OTHER PUBLICATIONS

Herald et al., "Evaluation of Organic and Inorganic Adsorbents . . . " in *Management of Low-Level Radioactive Waste*, vol. I, Pergammon Press 1979, pp. 399–410.

*Primary Examiner*—Deborah L. Kyle
*Attorney, Agent, or Firm*—Edward J. Brenner

[57] ABSTRACT

A process for treating a radioactive liquid waste is disclosed, in which a radioactive liquid waste containing uranium and $\beta$-decay nuclides, daughter nuclides of uranium, is treated by combination of a flocculation method using water glass as pretreatment and a subsequent ion exchange method. An approximately total amount of the uranium and a part of the $\beta$-decay nuclides, daughter nuclides of uranium, in the liquid waste are captured by an amorphous silica precipitate formed by addition of the water glass and a remaining part of the $\beta$-decay nuclides, daughter nuclides of uranium, is captured thereafter by the ion exchange treatment. The thus captured radioactive materials are respectively eluted from the filtered out precipitate, a radioactive solid waste, and the ion exchanger by acid treatment to be recovered as an acidic solution. Thus, the radioactive materials in the liquid waste are recovered approximately completely, thereby making the radioactivities of a final drain remarkably reduced. The precipitate is then dissolved in an alkali metal hydroxide solution to make the amorphous silica constituting the precipitate regenerated to water glass.

1 Claim, 3 Drawing Figures

PROCESS FOR TREATING A RADIOACTIVE LIQUID WASTE

This application is a continuation of application Ser. No. 149,034, filed May 12, 1980, now abandoned.

BACKGROUND OF THE INVENTION

The present invention relates to a process for treating a radioactive liquid waste which can bring about an approximately complete recovery of uranium and β-decay nuclids, daughter nuclides of uranium, from a radioactive liquid waste containing these radioactive materials and a remarkable reduction of the radioactivities of a final drain.

A process liquid waste discharged from the uranium hexafluoride reconversion process contains 50–200 ppm of uranium and a very small amount of β-decay nuclides, daughter nuclides of uranium. As a method for removing these radioactive nuclides from the above-mentioned process liquid waste, there have been proposed an ion exchange method, a flocculation method using iron chloride as a fluocculant and the like.

The ion exchange method comprises such processes as shown in FIG. 1. For effective use of ion exchange resins, it is usually required to regenerate the ion exchange resins, for example, about once a day. Therefore, in the continuous treatment of the above-mentioned process liquid waste from the uranium hexafluoride reconversion process, two series of ion exchange treatment lines are required to carry out the regeneration of the ion exchange resins simultaneously. On the other hand, the regeneration of the ion exchange resins requires a large amount of nitric acid, and after regeneration, a waste liquid containing the nitric acid is discharged, consequently a nitric acid recovering equipment is necessary. Further, the ion exchange resins are deteriorated by repeated regeneration. This deterioration of the ion exchange resins is thought to be attributable to 10–20 g/l of fluorine contained in the above-mentioned process liquid waste and the nitric acid used in the regeneration thereof. In addition to these defects, the ion exchange method has the following defect. Namely, the ion exchange method is indeed extremely effective for capturing the uranium contained in the above-mentioned process liquid waste, but when thorium, daughter nuclide of uranium, and uranium coexist in the said liquid waste, complete capture of the thorium by the ion exchange method is difficult owing to a high specific activity of thorium.

The flocculation method using iron chloride as a flocculant comprises such processes as shown FIG. 2. In this method, even though a precipitate capturing uranium in the above-mentioned process liquid waste is formed and the captured uranium is eluted by acid treatment of the precipitate to be recovered, separation of the eluted uranium from iron ions coexisting in large quantities is not easy, consequently the precipitate capturing uranium must be stored as a radioactive solid waste.

Further, in the flocculation method using water glass as a flocculant as disclosed in Japanese Patent Publication No. 38320 of 1973, uranium in the above-mentioned process liquid waste can be almost completely captured by an amorphous silica precipitate formed by addition of water glass, but β-decay nuclides such as thorium, daughter nuclides of uranium, can not necessarily be captured sufficiently and even when the captured radioactive nuclides are recovered from the precipitate, the residual precipitate can not be handled as a nonradioactive waste, consequently the precipitate capturing these radioactive nuclides has been stored intact as a radioactive solid waste.

BRIEF SUMMARY OF THE INVENTION

An object of the present invention is to provide a process for treating a radioactive liquid waste which can recover approximately completely uranium and β-decay nuclides, daughter nuclides or uranium, from a radioactive liquid waste containing uranium and β-decay nuclides, daughter nuclides of uranium.

Another object of the present invention is to provide a process for treating a radioactive liquid waste which can reduce remarkably the radioactivities of a final drain to be discharged.

A further object of the present invention is to provide a process for treating a radioactive liquid waste which can bring about a marked reduction of the deterioration of ion exchange resins.

According to the present invention, there is provided a process for treating a radioactive liquid waste as follows: In the process for treating a radioactive liquid waste which comprises removing uranium and β-decay nuclides, daughter nuclides of uranium, from a radioactive liquid waste containing uranium and β-decay nuclides, daughter nuclides of uranium, by an ion exchange method, improvements comprising treating said radioactive liquid waste by a flocculation method using water glass as pretreatment of said ion exchange method to make a precipitate composed substantially of an amorphous silica formed and to make said uranium and β-decay nuclides, daughter nuclides or uranium, captured by said formed precipitate.

The present invention comprises further treating said precipitate capturing said uranium and β-decay nuclides, daughter nuclides or uranium, a radioactive solid waste, with a dilute acid to make said captured uranium and β-decay nuclides, daughter nuclides of uranium, eluted, recovering said eluted uranium and β-decay nuclides, daughter nuclides of uranium, as an acidic solution by filtering out said precipitate, and dissolving said filtered out precipitate in an alkali metal hydroxide solution to regenerate said amorphous silica constituting said precipitate to water glass.

The present invention will be better understood from the following detailed description taken in connection with the accompanying drawings in which.

DETAILED DESCRIPTION OF THE INVENTION

The features of the present invention reside in that a radioactive liquid waste containing uranium and β-decay nuclides, daughter nuclides of uranium is treated by combination of a flocculation method using water glass as pretreatment and a subsequent ion exchange method.

Figure 1:
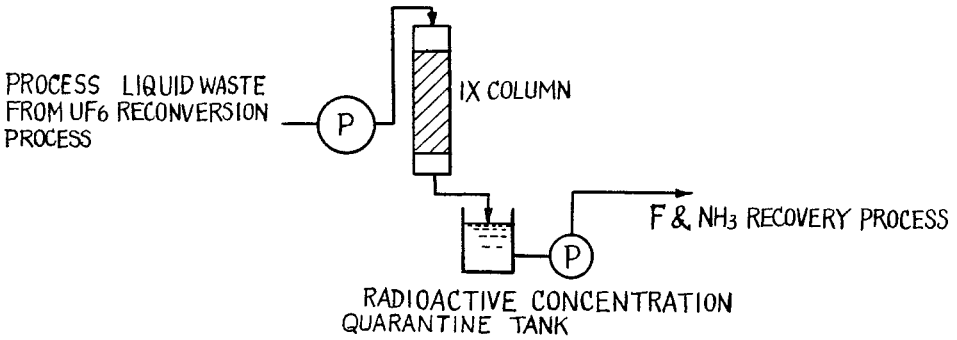
FIG. 1 is a flow sheet of an example of conventional process for treating a radioactive liquid waste from the uranium hexafluoride reconversion process by an ion exchange method.
Figure 2:
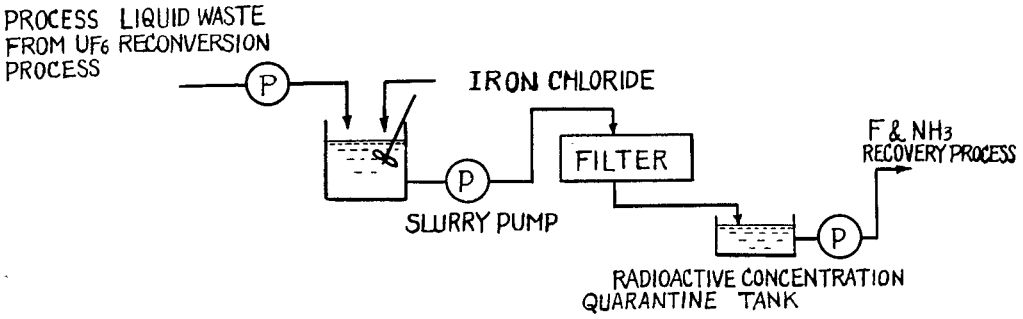
FIG. 2 is a flow sheet of an example of conventional process for treating a radioactive liquid waste from the uranium hexafluoride reconversion process by a flocculation method using iron chloride as a flocculant.
Figure 3:
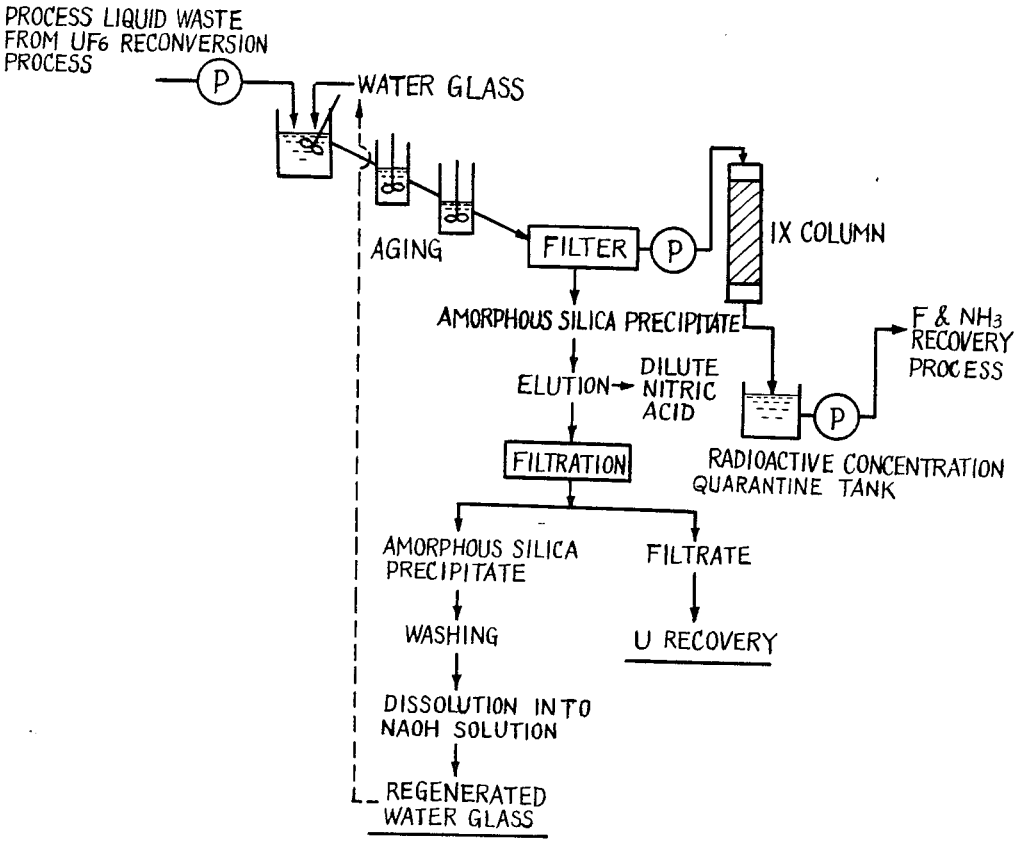
FIG. 3 is a flow sheet of a preferred embodiment of the present invention.

In the flow sheet of FIG. 3, there are contained a fundamental process of the present invention, namely, a flocculation process, in which an amorphous silica precipitate is formed by adding water glass as a flocculant to the above-mentioned radioactive liquid waste and a following regeneration process in which the amorphous silica constituting the said precipitate is regenerated to water glass.

Now, these two processes will be explained in detail by way of FIG. 3.

At first in the flocculation process, the process liquid waste containing uranium and $\beta$-decay nuclides, daughter nuclides of uranium, from the uranium hexafluoride reconversion process is added with water glass of 0.5–2 g/l in sodium silicate equivalent, stirred for 10–30 minutes, and aged to make a precipitate composed substantially of an amorphous silica formed and to make an approximately total amount of the uranium and a part of the $\beta$-decay nuclides, daughter nuclides of uranium, captured by the formed precipitate. Filtering out the amorphous silica precipitate capturing these radioactive nuclides, there is obtained a filtrate. By passing the filtrate through an ion exchanger column in the usual way, a remaining part of the $\beta$-decay nuclides, daughter nuclides of uranium in the filtrate which have not been captured by the amorphous silica precipitate in the flocculation process can be almost completely captured by the ion exchange resin. Therefore, the radioactivities of a final drain can be reduced to a level of about 1/10–1/100 of those of the conventional case in which the above-mentioned process liquid waste is treated only with an ion exchange process. Thus, since the flocculation treatment using water glass as pretreatment of the ion exchange can lighten greatly a burden on the ion exchange resin in the following ion exchange treatment, the degree of deterioration of the ion exchange resin can be reduced remarkably. Therefore, a quantity of the ion exchange resin to be exchanged can be markedly reduced and the number of regeneration of the ion exchange resin can be decreased from once a day in the conventional case in which the above-mentioned process liquid waste is treated only with the ion exchange method to once a month or 2 month, consequently there are obtained large economical merits.

Further, in the present invention, as described above, by treating the amorphous silica precipitate capturing an approximately total amount of uranium and a part of $\beta$-decay nuclides, daughter nuclides of uranium, in the process liquid waste formed by the flocculation treatment using water glass and filtered out by a filter, namely a radioactive solid waste, with a dilute acid and further an alkali metal hydroxide solution, the captured uranium and $\beta$-decay nuclides, daughter nuclides or uranium, can be recovered and the amorphous silica constituting the precipitate can be regenerated to water glass. Namely, as FIG. 3 shows, by treating the amorphous silica precipitate capturing an approximately total amount of uranium and a part of $\beta$-decay nuclides, daughter nuclides of uranium with such a dilute acid as nitric acid, these captured radioactive nuclides can be eluted to be recovered as an acidic solution by filtering out the amorphous silica precipitate and the filtered out amorphous silica precipitate can be dissolved in an alkali metal hydroxide solution to be regenerated to water glass. Therefore, the generation of the above-mentioned radioactive solid waste can be substantially completely depressed. In this case, a mole ratio of the amorphous silica to the alkali metal oxide, namely, $SiO_2/M_2O$ (M: alkali metal) is an important parameter in dissolving the amorphous silica in the alkali metal hydroxide solution to be regenerated to water glass. This mole ratio is preferable to be in the range of 1.5–3.5. Namely, when the mole ratio is above 3.5, the dissolution of the amorphous silica in the alkali metal hydroxide solution takes a long time and a regeneration ratio of the amorphous silica to water glass is decreased, and when the mole ratio is under 1.5, the solution becomes strongly alkaline, bringing about a lowering of the economical effects by generating corrosion of the apparatus and requiring a lager amount of the alkali metal hydroxide to be added. The thus regenerated water glass can be reused as a flocculant in the flocculation treatment of the above-mentioned process liquid waste. Moreover, in the dissolution of the amorphous silica precipitate in the alkali metal hydroxide solution, when the amorphous silica precipitate is previously washed with water sufficiently to remove anions such as nitric acid radical attached to the precipitate, the amorphous silica precipitate can be more easily dissolved in the alkali metal hydroxide solution, thereby bringing about a more effective regeneration of the amorphous silica constituting the precipitate to water glass. The degree of the washing is desirable to be judged, for example, by measurement of an electric conductivity of a wash liquid after washing. The electric conductivity of the wash liquid is preferable to be decreased to about 10 $m\Omega^{-1}/cm$. In FIG. 3, as the alkali metal hydrocide solution is used a sodium hydroxide solution, but it is not limited to a sodium hydroxide solution.

The present invention, as described above, by treating a radioactive liquid waste containing uranium and $\beta$-decay nuclides, daughter nuclides of uranium, by combination of a flocculation method using water glass as pretreatment and a subsequent ion exchange method, can bring about an approrimately complete recovery of uranium and $\beta$-decay nuclides, daughter nuclides of uranium, from the radioactive liquid waste and a remarkable reduction of the radioactivities of a final drain. Further, the present invention can also bring about a marked reduction of the degree of deterioration of the ion exchange resin accompanying a striking decrease of the number of regeneration thereof. Therefore, the present invention is very useful in the treatment of a radioactive liquid waste from the uranium hexafluoride reconversion process.

The present invention will be understood more readily with reference to the following examples. The examples, however, are intended to illustrate the present invention and are not construed to limit the scope of the present invention.

EXAMPLE 1

A process liquid waste containing uranium and $\beta$-decay nuclides, daughter nuclides of uranium, discharged from the uranium hexafluoride reconversion process is added with water glass of 1.5 g/l in sodium silicate equivalent in the flocculation treatment as pretreatment, stirred for 15 minute and aged to make an amorphous silica precipitate formed. By filtering out the formed amorphous silica precipitate, there is obtained a filtrate. The filtrate is treated with anion exchange resin. The results of the measurement of the respective radioactive concentration of the process liquid waste before the flocculation treatment, the filtrate after the flocculation treatment, and the filtrate after the ion exchange treatment are as follows.

In the process liquid waste before the flocculation treatment:

$\alpha$ (uranium) concentration $=2\times10^{-4}\mu$Ci/cc, $\beta$ concentration $=5\times10^{-5}\mu$Ci/cc In the filtrate after the flocculation treatment:

$\alpha$ concentration $<6\times10^{-7}\mu$Ci/cc, $\beta$ concentration $=4\times10^{-5}\mu$Ci/cc In the filtrate after the ion exchange treatment:

$\alpha$ concentration $<6\times10^{-7}\mu$Ci/cc $\beta$ concentration $<2\times10^{-6}\mu$Ci/cc Thus, in the filtrate after the ion exchange treatment which corresponds to a final drain, uranium and $\beta$-decay nuclides, daughter nuclides of uranium are almost completely removed.

EXAMPLE 2

The amorphous silica precipitate formed by addition of water glass in the flocculation treatment and filtered out in Example 1 is treated with 2N nitric acid to make the captured uranium and $\beta$-decay nuclides, daughter nuclides of uranium eluted. These eluted radioactive nuclides are recovered as a nitric acid solution by filtering out the amorphous silica precipitate. The filtered out precipitate is washed sufficiently with water to remove the anions such as $NO_3^{-1}$ attached to the precipitate. This washed amorphous silica precipitate is dissolved under stirring at 25° C. in a sodium hydroxide solution in which a mole ratio of $SiO_2/Na_2O$ is adjusted to be 3 and the amorphous silica is regenerated to a water glass reusable as a flocculant in the flocculation treatment. Thus, the generation of the above-mentioned radioactive solid waste can be substantially completely depressed.

What is claimed is:

1. In a system for treating a radioactive liquid waste which comprises removing uranium and $\beta$-decay nuclides in solution from a radioactive liquid waste containing uranium and $\beta$-decay nuclides by an ion exchange process, the improvement comprising treating said radioactive liquid waste by a flocculation method using water glass as pretreatment of said ion exchange method to make a precipitate composed substantially of an amorphous silica and substantially all of said uranium and a part of said $\beta$-decay nuclides which are captured by said precipitate when it is formed, treating said precipitate capturing substantially all of said uranium and a part of $\beta$-decay nuclides with a dilute acid to make said captured uranium and $\beta$-decay nuclides elute, recovering said eluted uranium and $\beta$-decay nuclides as an acidic solution by filtering out said precipitate and dissolving said filtered out precipitate in an alkali metal hydroxide solution to regenerate said amorphous silica constituting said precipitate to water glass, thereby resulting concurrently in a substantial reduction of radioactive material in a final drain to be discharged and deterioration of ion exchange resin, a substantially complete recovery of of said uranium and a part of $\beta$-decay nuclides from said radioactive liquid waste and further, a substantially complete prevention of the generation of radioactive decay products of uranium on said ion exchange resins.

* * * * *